US010562729B2

(12) United States Patent
Ando et al.

(10) Patent No.: US 10,562,729 B2
(45) Date of Patent: Feb. 18, 2020

(54) SHEET STACKING DEVICE, COUNTER EJECTOR AND BOX MAKING MACHINE

(71) Applicant: MITSUBISHI HEAVY INDUSTRIES MACHINERY SYSTEMS, LTD., Hyogo (JP)

(72) Inventors: Kazuhiro Ando, Hiroshima (JP); Kazuya Sugimoto, Hiroshima (JP); Osamu Hatano, Hiroshima (JP); Shinya Iori, Hiroshima (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 0 days.

(21) Appl. No.: 15/743,120

(22) PCT Filed: Feb. 25, 2016

(86) PCT No.: PCT/JP2016/055659
§ 371 (c)(1),
(2) Date: Jan. 9, 2018

(87) PCT Pub. No.: WO2017/043103
PCT Pub. Date: Mar. 16, 2017

(65) Prior Publication Data

US 2018/0229958 A1 Aug. 16, 2018

(30) Foreign Application Priority Data

Sep. 10, 2015 (JP) ..... 2015-178514

(51) Int. Cl.
*B65H 29/52* (2006.01)
*B65H 29/54* (2006.01)
(Continued)

(52) U.S. Cl.
CPC ..... *B65H 29/22* (2013.01); *B65H 29/52* (2013.01); *B65H 31/26* (2013.01); *B65H 2701/176* (2013.01)

(58) Field of Classification Search
CPC ..... B65H 29/52; B65H 29/22; B65H 29/14; B65H 2404/74; B65H 29/54; B65H 29/56; B65H 2701/176
See application file for complete search history.

(56) References Cited

U.S. PATENT DOCUMENTS 3,759,402 A 9/1973 Hitch et al.
5,472,185 A * 12/1995 Kollann ..... B65H 29/58 198/367
(Continued)

FOREIGN PATENT DOCUMENTS

CH 655706 A5 5/1986
CN 103269849 A 8/2013
(Continued)

OTHER PUBLICATIONS

International Search Report and Written Opinion in PCT/JP2016/055659, dated May 17, 2016. 14pp.
(Continued)

*Primary Examiner* — Luis A Gonzalez
(74) *Attorney, Agent, or Firm* — Hauptman Ham, LLP

(57) ABSTRACT

Provided are a sheet stacking device, a counter ejector and a box making machine, wherein: a hopper unit stacks sheet-like cardboard boxes; feeding rolls feed a cardboard box to the hopper unit; and a guiding device is disposed between the feeding rolls and the hopper unit and includes a first guide part that extends in a horizontal direction and guides a lower surface of the cardboard box and a second guide part that extends in a vertical direction and guides a rear end of the cardboard box. Due to this configuration, the occurrence of damage to box making sheets in high-speed
(Continued)

conveying of the box making sheets can be suppressed and the box making sheets can be appropriately stacked in a prescribed posture.

11 Claims, 8 Drawing Sheets

(51) Int. Cl.
*B65H 29/22* (2006.01)
*B65H 31/26* (2006.01)

(56) References Cited

U.S. PATENT DOCUMENTS

| | | | | |
|---|---|---|---|---|
| 6,971,295 | B2 * | 12/2005 | Teshima | B65H 29/12 271/188 |
| 7,125,216 | B2 * | 10/2006 | Grewe | B26D 7/0675 414/790.8 |
| 2010/0190626 | A1 | 7/2010 | Taketsugu et al. | |
| 2013/0184133 | A1 | 7/2013 | Sugimoto et al. | |
| 2016/0200063 | A1 | 7/2016 | Iori et al. | |

FOREIGN PATENT DOCUMENTS

| | | | |
|---|---|---|---|
| JP | S49100770 | | 9/1974 |
| JP | H02072263 | U | 6/1990 |
| JP | 4-350060 | A | 12/1992 |
| JP | H09240909 | A | 9/1997 |
| JP | 2003-221146 | A | 8/2003 |
| JP | 2009-51024 | A | 3/2009 |
| JP | 2011068445 | A | 4/2011 |
| JP | 2012201483 | A | 10/2012 |
| JP | 2015-93451 | | 5/2015 |
| WO | 2015/072215 | A1 | 5/2015 |

OTHER PUBLICATIONS

European Search Report in EP Application No. 16843969.3, dated Jun. 8, 2018, 7pp.
Office Action for Chinese Application No. 201680039862.2 dated Jan. 16, 2019; 6pp.
Office Action for Japanese Application No. 2015-178514 dated Mar. 27, 2019; 8pp.

* cited by examiner

SHEET STACKING DEVICE, COUNTER EJECTOR AND BOX MAKING MACHINE

RELATED APPLICATIONS

The present application is a National Phase of PCT/JP2016/055659, filed Feb. 25, 2016, and claims priority based on Japanese Patent Application No. 2015-178514, filed Sep. 10, 2015.

TECHNICAL FIELD

The present invention relates to a sheet stacking device that stacks manufactured sheet-like cardboard boxes to form a stack, a counter ejector to which this sheet stacking device is applied and which collects and counts cardboard sheets to eject the cardboard sheets in a batch, and a box making machine to which this counter ejector is applied.

BACKGROUND ART

General box making machines process sheet materials (for example, cardboard sheets), thereby manufacturing box members (cardboard boxes), and are constituted of a sheet feed section, a printing section, a slotter creaser section, a die cutting section, a folder gluer section, and a counter ejector section. The sheet feed section feeds cardboard sheets stacked on a table one by one to send the cardboard sheets to the printing section at a constant speed. The printing section has a printing unit and performs printing on a cardboard sheet. The slotter creaser section forms ruled lines serving as folding lines on the printed cardboard sheet, and performs processing of grooves forming flaps and glue margin strips for joining. The die cutting section performs drilling for hand holes on the cardboard sheet in which the ruled lines, the grooves, and the glue margin strips are formed. The folder gluer section applies glue to the glue margin strips, performs folding along the ruled lines, and joining the glue margin strips while moving the cardboard sheet in which the ruled lines, the grooves, the glue margin strips, and the hand holes are processed, thereby manufacturing a flat cardboard box. The counter ejector section stacks cardboard boxes obtained by the cardboard sheets being folded and glued, and then sorts and ejects the cardboard boxes in a batch of a predetermined number of sheets.

The counter ejector section of such box making machines is disposed at a most downstream part of each box making machine, collects, counts, and the counter ejector section stacks the manufactured sheet-like cardboard boxes, and elects the cardboard boxes in a batch of a predetermined number of sheets. This counter ejector section has a hopper that stacks cardboard boxes, stops the movement of a cardboard box, which is ejected to a position above the hopper in a horizontal state by ejection rolls, in a transport direction, and drops the cardboard box on the hopper to stack cardboard boxes by a predetermined number of sheets. As such box making machines, for example, there is one described in the following PTL 1.

CITATION LIST

Patent Literature

[PTL 1] Japanese Unexamined Patent Application Publication No. 2015-093451

SUMMARY OF INVENTION

Technical Problem

In recent years, in such a box making machine, speeding-up has progressed. However, if the production rate is increased, the behavior of cardboard boxes becomes unstable and it becomes difficult to stack the cardboard boxes in order on the hopper in a correct posture. Particularly, since a lightweight large-sized cardboard box does not have sufficient rigidity, a distal end of the cardboard box is tilted downward and forward from when being ejected to a position above the hopper in a horizontal state by the ejection rolls. Then, since the cardboard box is stacked in state where its distal end is bent, when a ledge enters the hopper to collect cardboard boxes to form the stack, a distal end of the ledge and the distal end of the cardboard box come into contact with each other and the cardboard box breaks. Additionally, if the distal end of the cardboard box is tilted forward and downward, the cardboard box stays within the hopper in the forwardly tilted state after this distal end comes into contact with another cardboard box that is stacked previously, and the following cardboard sheet may not be appropriately stacked. Additionally, there is a problem that the distal end of the ledge that enters the hopper may come into contact with the rear end of the cardboard box that stays within the hopper in the forwardly tilted state and the rear end of the cardboard box may break.

The invention is to solve the above-described problems, and an object thereof is to provide a sheet stacking device, a counter ejector, and a box making machine capable of suppressing occurrence of damage to box making sheets with respect to high-speed transport of the box making sheets and appropriately stacking the box making sheets in a predetermined posture.

Solution to Problem

A sheet stacking device of the invention for achieving the above object includes a hopper unit that stacks box making sheets; an ejection unit that ejects each of the box making sheets to the hopper unit; and a guide device that is disposed between the ejection unit and the hopper unit and has a first guide part that guides a lower surface of the box making sheet in a horizontal direction, and a second guide part that guides a rear end of the box making sheet in a vertical direction.

Therefore, if the box making sheet is ejected by the ejection unit, the box making sheet has the lower surface supported by the first guide part. Accordingly, the downward and forward tilting of a distal end of the box making sheet can be suppressed, and damage to the distal end can be suppressed by collision against the box making sheet stacked on the hopper unit being avoided. Additionally, if the box making sheet slips out of the ejection unit, the box making sheet is brought into a free state. However, the box making sheet can be appropriately stacked while its horizontal state is maintained by its rear end being supported by the second guide part. As a result, occurrence of damage to the box making sheet with respect to high-speed transport of the box making sheet can be suppressed, and the box making sheet can be appropriately stacked in a predetermined posture.

In the sheet stacking device of the invention, the guide device has a guide roll that protrudes upward in the vertical direction from a first guide surface of the first guide part to guide the lower surface of the box making sheet.

Therefore, since the guide roll protrudes upward from the first guide surface, the box making sheet ejected by the ejection unit has the lower surface supported by the rotating guide roll. As a result, occurrence of scratch of the lower surface of the box making sheet can be suppressed.

In the sheet stacking device of the invention, the first guide part is provided with a first cutout that passes therethrough in the vertical direction, and a portion of an outer peripheral surface of the guide roll protrudes upward from the first guide surface through the first cutout.

Therefore, the guide roll protrudes upward from the first guide surface through the first cutout. Accordingly, the box making sheet has the lower surface supported by the first guide surface and the guide roll. As a result, the box making sheet can be appropriately guided.

In the sheet stacking device of the invention, the second guide part is provided with a second cutout that passes therethrough in the horizontal direction, and a portion of an outer peripheral surface of the guide roll protrudes from the second guide surface to a side of the hopper unit through the second cutout.

Therefore, the guide roll protrudes forward from the second guide surface through the second cutout, and the guide roll is rotated by the box making sheet to be ejected. Thus, the box making sheet is pushed downward by its rear end coming to contact with the rotating guide roll. As a result, the behavior of the box making sheet can be stabilized and the box making sheet can be appropriately stacked on the hopper unit.

In the sheet stacking device of the invention, the first guide part and the second guide part are constituted by a guide plate having an L-shaped section, and the first cutout and the second cutout are constituted as one cutout that passes through a region including a bending part of the guide plate.

Therefore, the first guide part and the second guide part are constituted by the guide plate, and the first cutout and the second cutout are formed as one cutout that passes through the region including the bending part of the guide plate. Therefore, the structure can be simplified, and the processing cost can be suppressed.

In the sheet stacking device of the invention, the guide plate includes a plurality of split guide plates that are split in a width direction.

Therefore, the guide plate is split in the width direction. Accordingly, the processing accuracy can be improved, and the processing cost can be suppressed.

In the sheet stacking device of the invention, a cover that covers the side of the hopper unit is disposed in the ejection unit, and the guide device is mounted on the cover.

Therefore, the guide device is mounted on the cover of the ejection unit. Accordingly, the guide device can be supported via an existing member, an increase in cost can be suppressed by suppressing an increase in the number of attachment members, and easiness of assembling can be improved.

In the sheet stacking device of the invention, the guide device has a first adjusting device that adjusts a position of the first guide part in the vertical direction.

Therefore, the first guide part can be disposed at an optimal position by adjusting the position of the first guide part in the vertical direction using the first adjusting device during the assembling of the guide device.

In the sheet stacking device of the invention, the guide device has a second adjusting device that adjusts a position of the second guide part in the horizontal direction.

Therefore, the second guide part can be disposed at an optimal position by adjusting the position of the second guide part in the horizontal direction using the second adjusting device during the assembling of the guide device.

In the sheet stacking device of the invention, the ejection unit has an upper ejection roll and a lower ejection roll in which a circumferential groove is formed, the guide device has a third guide part of which a base end is coupled to the first guide part, and the third guide part has a distal end disposed within the circumferential groove.

Therefore, the third guide part is disposed between the first guide part and the lower ejection roll. Accordingly, the box making sheet ejected by the ejection rolls can be appropriately transported to the first guide part by the third guide part.

Additionally, a counter ejector of the invention includes the above sheet stacking device, and the box making sheets are sorted in a batch of a predetermined number of sheets and are ejected after being stacked while being counted.

Therefore, if the box making sheet is ejected by the ejection unit, the box making sheet has the lower surface supported by the first guide part. Accordingly, the downward and forward tilting of a distal end of the box making sheet can be suppressed, and damage to the distal end can be suppressed by collision against the box making sheet stacked on the hopper unit being avoided. Additionally, if the box making sheet slips out of the ejection unit, the box making sheet is brought into a free state. However, the box making sheet can be appropriately stacked while its horizontal state is maintained by its rear end being supported by the second guide part. As a result, occurrence of damage to the box making sheet with respect to high-speed transport of the box making sheet can be suppressed, and the box making sheet can be appropriately stacked in a predetermined posture.

Additionally, a box making machine of the invention includes a sheet feed section that supplies a box making sheet; a printing section that performs printing on the box making sheet; a slotter creaser section that performs ruling on a front surface of the box making sheet and performs grooving; a folder gluer section that folds the box making sheet to join ends together, thereby forming a box member; and a counter ejector section that ejects every predetermined number of the box members after being stacked while being counted. The above counter ejector is applied as the counter ejector section.

Therefore, printing is performed on the box making sheet from the sheet feed section by the printing section, ruling and grooving are performed by the slotter creaser section, folding is performed by the folder gluer section to join ends together to form the box member, and the box member is stacked while being counted by the counter ejector section. In this case, in the counter ejector section, if the box making sheet is ejected by the ejection unit, the box making sheet has the lower surface supported by the first guide part. Accordingly, the downward and forward tilting of a distal end of the box making sheet can be suppressed, and damage to the distal end can be suppressed by collision against the box making sheet stacked on the hopper unit being avoided. Additionally, if the box making sheet slips out of the ejection unit, the box making sheet is brought into a free state. However, the box making sheet can be appropriately stacked while its horizontal state is maintained by its rear end being supported by the second guide part. As a result, occurrence of damage to the box making sheet with respect to high-speed transport of the box making sheet can be suppressed, and the box making sheet can be appropriately stacked in a predetermined posture.

Advantageous Effects of Invention

According to the sheet stacking device, the counter ejector, and the box making machine of the invention, the guide device is disposed between the ejection unit and the hopper unit and has the first guide part that guides the lower surface of the box making sheet in the horizontal direction, and the second guide part that guides the rear end of the box making sheet in the vertical direction. Thus, occurrence of damage to the box making sheets in high-speed transport of the box making sheets can be suppressed, and the box making sheets can be appropriately stacked in a predetermined posture.

DESCRIPTION OF EMBODIMENTS

Preferred embodiments of a sheet stacking device, a counter ejector, a box making machine related to the invention will be described below in detail with reference to the accompanying drawings. In addition, the invention is not limited to the embodiments and includes those configured by combining respective embodiments in a case where there are a plurality of embodiments.

Figure 1:
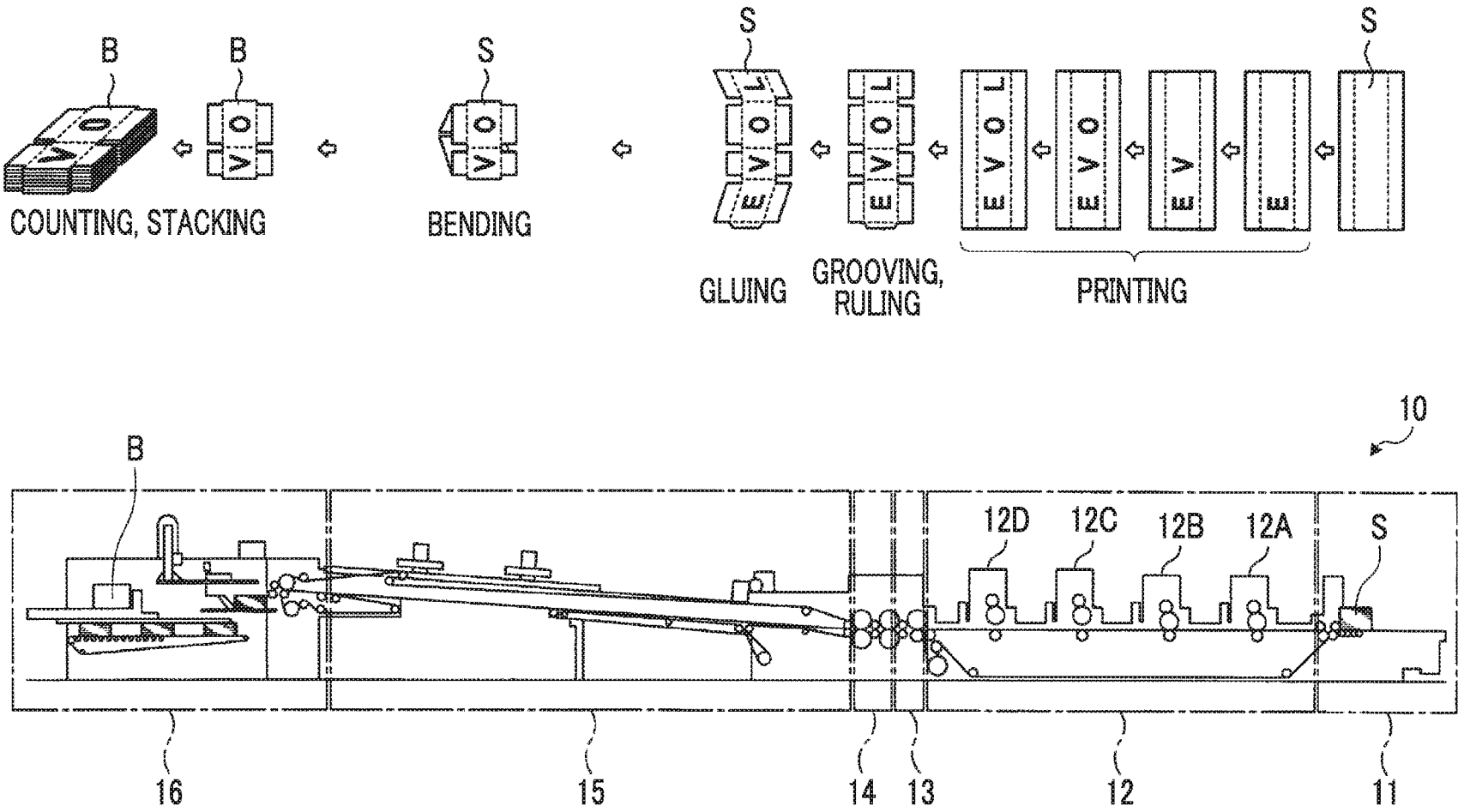
FIG. 1 is a schematic configuration view illustrating a box making machine of the present embodiment.

First, the box making machine of the present embodiment will be described. FIG. 1 is a schematic configuration view illustrating the box making machine of the present embodiment.

In the present embodiment, as illustrated in FIG. 1, a box making machine 10 manufactures a cardboard box (box member) B by processing a cardboard sheet S. The box making machine 10 is constituted of a sheet feed section 11, a printing section 12, a slotter creaser section 13, a die cutting section 14, a folder gluer section 15, and a counter ejector section 16 that are linearly disposed in a direction in which the cardboard sheet S and the cardboard box B are transported.

In the sheet feed section 11, a number of plate-shaped cardboard sheets S are carried in a stacked state, and the cardboard sheets S are ejected one by one and are sent to the printing section 12 at a constant speed. The printing section 12 performs multi colored printing (four-color printing in the present embodiment) on a front surface of each cardboard sheet S. The printing section 12 has four printing units 12A, 12B, 12C, and 12D disposed in series, and is capable of performing printing on the front surface of the cardboard sheet S using four ink colors. The slotter creaser section 13 performs ruling and performs grooving on the cardboard sheet S.

The die cutting section 14 performs drilling for hand holes on the cardboard sheet S. The folder gluer section 15 folds the cardboard sheet S while moving the cardboard sheet S in a transport direction, and joins both ends thereof in a width direction to form a flat cardboard box B. The counter ejector section 16 stacks cardboard boxes B manufactured by the folder gluer section 15 while counting the cardboard boxes B, and then sorts and ejects the cardboard boxes B in a batch of a predetermined number of sheets.

Figure 2:
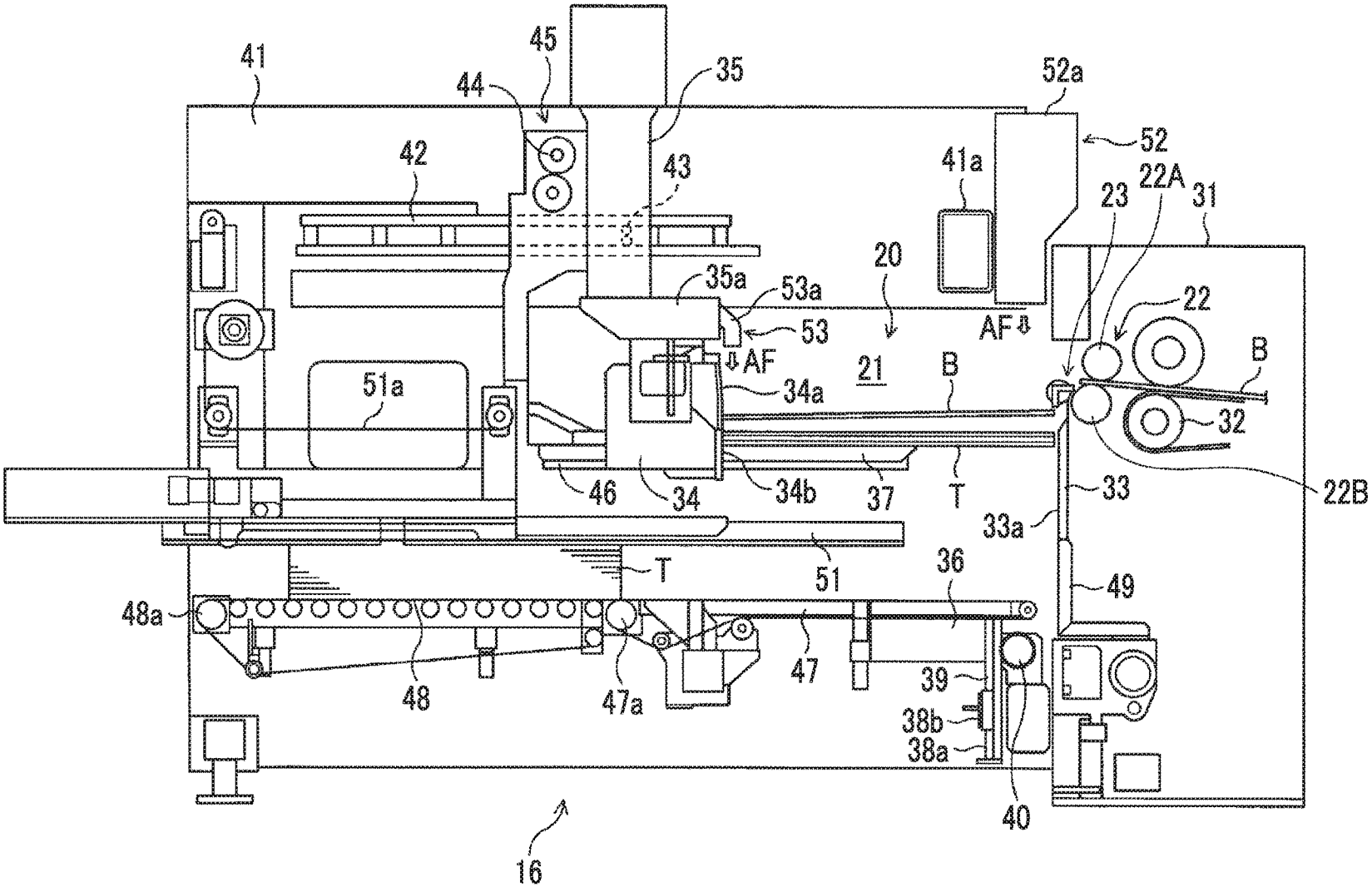
FIG. 2 is a schematic configuration view illustrating a counter ejector of the present embodiment.

Next, the counter ejector section 16 of the present embodiment will be described in detail. FIG. 2 is a schematic configuration view illustrating the counter ejector of the present embodiment.

As illustrated in FIG. 2, the counter ejector section (counter ejector) 16 of the present embodiment has a sheet stacking device 20 of the present embodiment. The sheet stacking device 20 includes a hopper unit 21 that stacks sheet-shaped cardboard boxes (box making sheets) B, an ejection roll (ejection unit) 22 that ejects each cardboard box B to the hopper unit 21, and a guide device 23 that is disposed between the ejection roll 22 and the hopper unit 21.

Frames 31 are respectively erected on both sides, in a machine width direction, of an inlet part of the counter ejector 16, and a roller 32 for an outlet part (rearmost part) conveyor of the folder gluer section 15 and a pair of upper and lower ejection rolls 22 are attached to the frames 31. The ejection rolls 22 have an upper ejection roll 22A and a lower ejection roll 22B, and pinch the cardboard box B from above and below to eject the cardboard box to a transport passage running in a horizontal direction.

A rear part of each ejection roll 22 is provided with a spanker 33 that presses a rear end of a stack (in which a plurality of cardboard boxes B are stacked) T. The spanker 33 is provided with an abutting surface 33*a* against which a rear end of the cardboard box B abuts, and a part below an intermediate part of the abutting surface 33*a* is provided in a vertical direction. However, an upper end of an upper part of the abutting surface 33*a* is inclined so as to shift to an upstream side in a transport direction of the cardboard box B.

A space where the stack T is formed as cardboard boxes B are stacked is provided below an outlet side of the ejection rolls 22, and this space serves as the hopper unit 21. The ejection rolls 22 eject the cardboard box B toward an upper space of the hopper unit 21.

Additionally, the election rolls 22 face a downstream side in the transport direction of the cardboard box B, and a flexible front stopper 34, which stops the cardboard box B ejected from the folder gluer section 15 while decelerating the cardboard box B, is supported so as to be movable in a forward-backward direction. That is, the front stopper 34 is provided so as to be movable in the forward-backward direction by a motor (not illustrated) with respect to a supporting part 35*a* of a ledge support 35. The front stopper 34 has a flexible stop plate 34*a* formed of a flexible material, and is capable of stopping the movement the cardboard box B in the transport direction while decelerating the cardboard box B while being elastically deformed itself if a front end of the cardboard box B abuts thereagainst. However, a high-rigidity stop plate 34*b* formed of, for example, a high-rigidity material, such as metal, is provided at a lower part of the flexible stop plate 34*a*, and the flexible stop plate 34*a* is capable of restricting the movement of the stack T at a front edge of the stack T as a rear end of the stack T is pressed by the spanker 33.

An elevator 36 is provided below the hopper unit 21, and the hopper unit 21 is capable of having the stack T collected from a ledge 37 to the middle transferred thereto, receiving cardboard boxes B that have hit the front stopper 34 and have fallen therefrom, on the stack T, and collecting the cardboard boxes B to form the stack T of a predetermined number of sheets. The elevator 36 is disposed horizontally below a portion slightly in front of the ejection rolls 22, is supported by a supporting shaft 39 provided with a rack 38*a*, and is configured so as to be reciprocable in an upward-downward direction by a driving mechanism consisting of the rack 38*a*, a pinion 38*b* to mesh with the rack 38*a*, and a servo motor 40 combined with the pinion 38*b*.

Side frames 41 are respectively provided on both sides in the machine width direction on the downstream side of the hopper unit 21 in the transport direction of the cardboard box B in the counter ejector 16, rails 42 are horizontally provided in the side frames 41, and the ledge support 35 is supported by the rails 42 on both sides so as be capable of traveling. That is, the ledge support 35 is provided with a roller 43 that travels on each rail 42, a pinion (not illustrated) that meshes with a rack (not illustrated) provided along the rail 42, and a ledge back-and-forth servo motor 44 that rotationally drives this pinion. For that reason, the ledge support 35 can be moved in the forward-backward direction by driving the ledge back-and-forth servo motor 44 to normally and reversely rotating ledge back-and-forth servo motor 44.

The ledge support 35 is provided with the ledge 37 that horizontally extends via a lifting mechanism 45. Although not illustrated, the lifting mechanism 45 is constituted of a rack-and-pinion mechanism, a ledge lifting servo motor that rotationally drives this pinion, and the like, and the ledge support 35 is capable of being lifted and lowered by the normal and reverse rotation of the servo motor.

The ledge 37 receives cardboard boxes B that have abutted against the front stopper 34 and have fallen therefrom, and collects the cardboard boxes B to form the stack T. The stack T is transferred to the elevator 36 while being formed. Thereafter, if cardboard boxes B are further collected on the elevator 36 and the stack T reaches a setting number of sheets, the elevator 36 is replaced to receive cardboard boxes B in order to operate again and to form the following stack T.

A press bar 46 that presses the stack T is supported on the ledge 37 so as to be capable of being lifted and lowered by a lifting mechanism (not illustrated). This lifting mechanism is also constituted of a rack-and-pinion mechanism (not illustrated), and a press bar lifting servo motor (not illustrated) that rotationally drives this pinion, and the press bar 46 is capable of being lifted and lowered by the normal and reverse rotation of the servo motor.

That is, a lower conveyor 47 is provided at the same height level as an upper surface of the elevator 36 when the elevator 36 has moved downward to the maximum, and an ejection conveyor 48 is further provided at a height position at the same level as the lower conveyor 47 downstream of the lower conveyor. The lower conveyor 47 and the ejection conveyor 48 are respectively driven by a servo motor 47*a* for the lower conveyor, and a servo motor 48*a* for the ejection conveyor. The lower conveyor 47 is installed to enter the back of the elevator 36 so that an inlet tip position is located sufficiently close to a pusher 49 so as to be capable of receiving even a cardboard box B of a minimum length (transport direction length is a minimum).

Moreover, an upper conveyor 51, which pinches the stack T together with the lower conveyor 47 and the ejection conveyor 48, is supported above the lower conveyor 47 and the ejection conveyor 48 such that the position thereof in a height direction is capable of being adjusted via a moving mechanism 51*a*. Additionally, the upper conveyor 51 is movable also in the forward-backward direction, and is configured so as to move up to a certain distance from the front stopper 34 in conjunction with the front stopper 34 in accordance with the cardboard box B.

Fans (blowing devices) 52 and 53, which blow air AF downward from above against an upper surface of the cardboard box B ejected from the ejection rolls 22, are provided above the elevator 36 (namely, above the hopper unit 21). The fans 52 are fixed fans (fixed blowing devices) fixed to a beam 41*a* supported by both the side frames 41, and the fans 53 are movable fans (movable blowing devices) that are fixed to the supporting part 35*a* supporting the front stopper 34 and that move in the forward-backward direction together with the front stopper 34.

In the present embodiment, all the fixed fans 52 are disposed at positions largely spaced apart upward from the height level of the outlet of the ejection rolls 22 in the vicinity of uppers ends of both the side frames 41, while the movable fans 53 are disposed at positions largely spaced apart upward from the outlet of the election rolls 22 in the vicinity of an upper end of the front stopper 34. Accordingly, as the fixed fans 52 on the upstream side in the transport direction are spaced apart from the cardboard box B, wind speed decreases but a blowing range widens. Thus, even if the movable fans 53 are not actuated, wind can be applied to the whole surface of the cardboard box B unless the size of the cardboard box B in the transport direction becomes large.

Meanwhile, since the movable fans 53 on the downstream side in the transport direction approach the cardboard box B, strong wind can be partially applied to the front end of the cardboard box B, and the movable fans 53 can be effectively used if the movable fans are used in a case where total air volume is insufficient only with the fixed fans 52. Moreover, since the movable fans 53 are fixed to the front stopper 34 side, the movable fans are adjusted such that wind is automatically blown against the front end of the cardboard box B in accordance with sheet length.

All the fans 52 and 53 are also adapted such that the blowing directions thereof face vertically downward, that is, a direction orthogonal to a substantially horizontal direction that is a proper direction of a surface of the cardboard box B ejected from the ejection rolls 22, and all the fans 52 and 53 are also covered with ducts 52*a* and 53*a* and are adapted such that the blowing directions thereof face vertically downward while being straightened by the ducts 52*a* and 53*a*.

Figure 3:
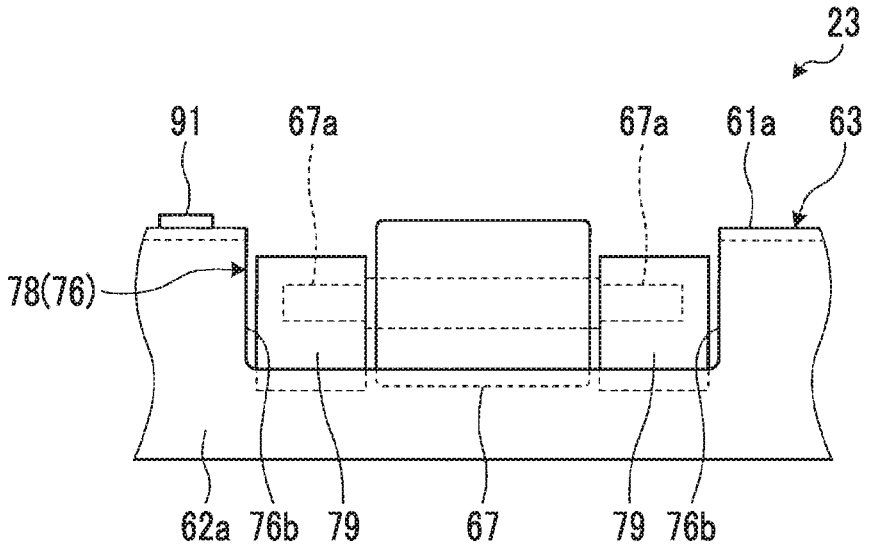
FIG. 3 is a front view illustrating a guide device in a sheet stacking device of the present embodiment.
Figure 4:
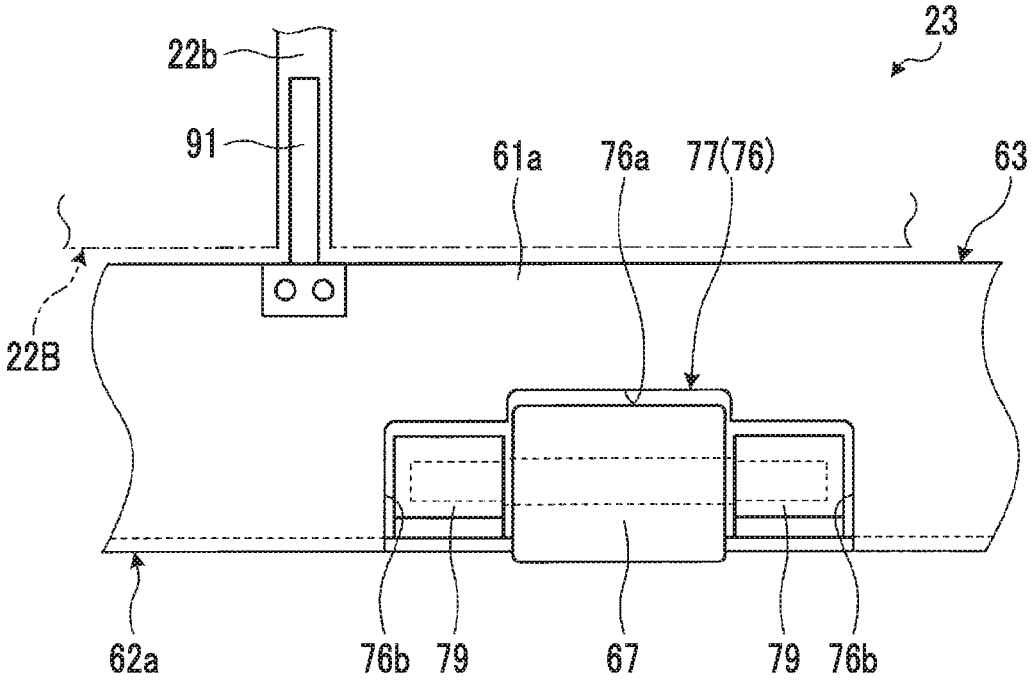
FIG. 4 is a plan view illustrating the guide device.
Figure 5:
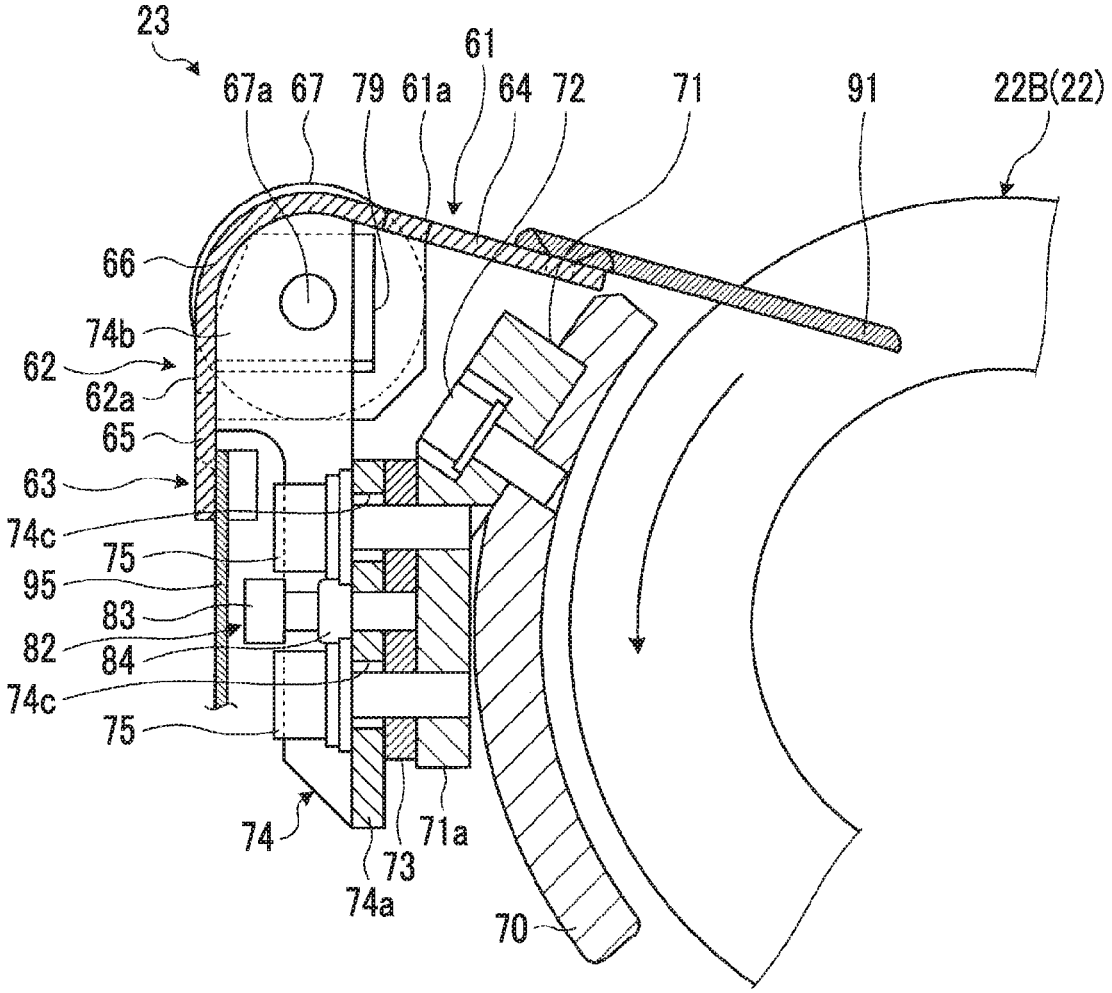
FIG. 5 is a longitudinal sectional view illustrating a forward-backward adjustment device in the guide device.
Figure 6:
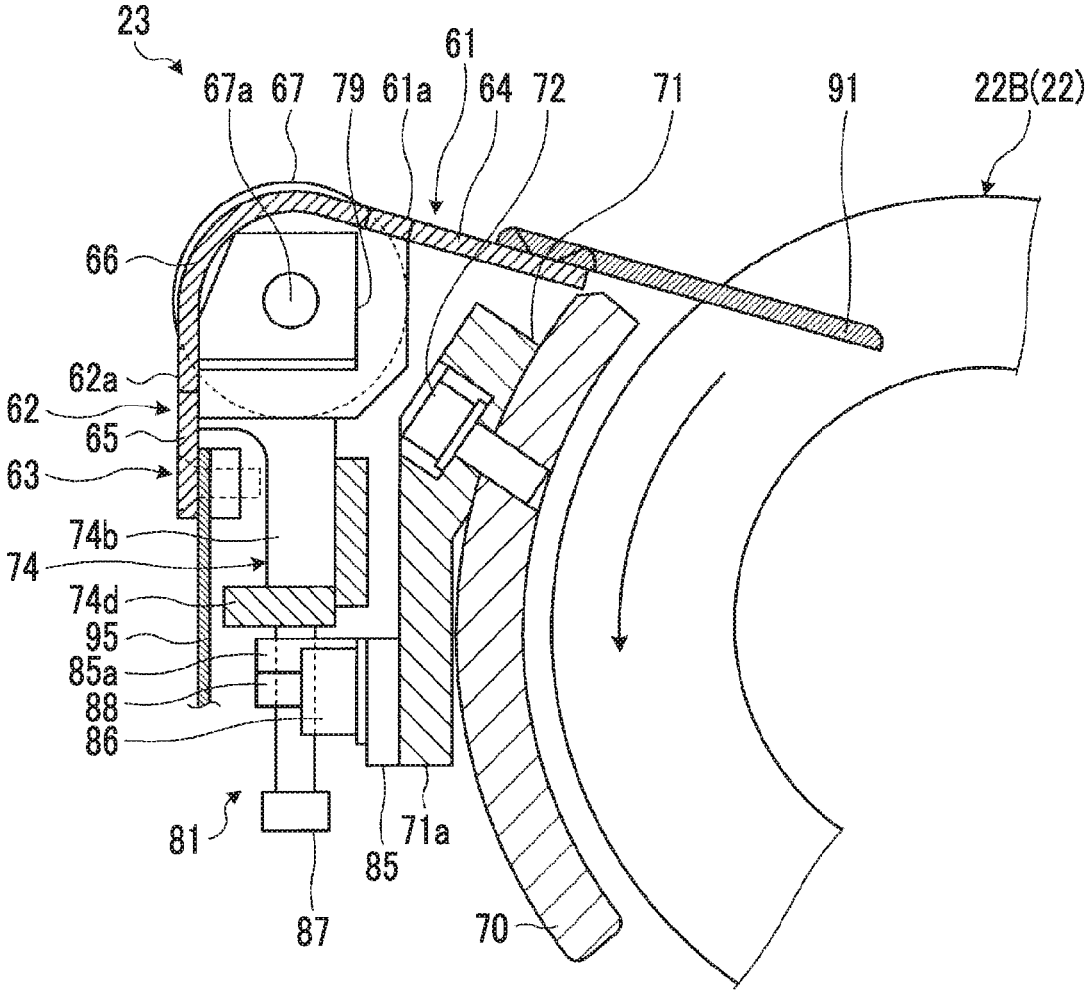
FIG. 6 is a longitudinal sectional view illustrating an upward-downward adjustment device in the guide device.
Figure 7:
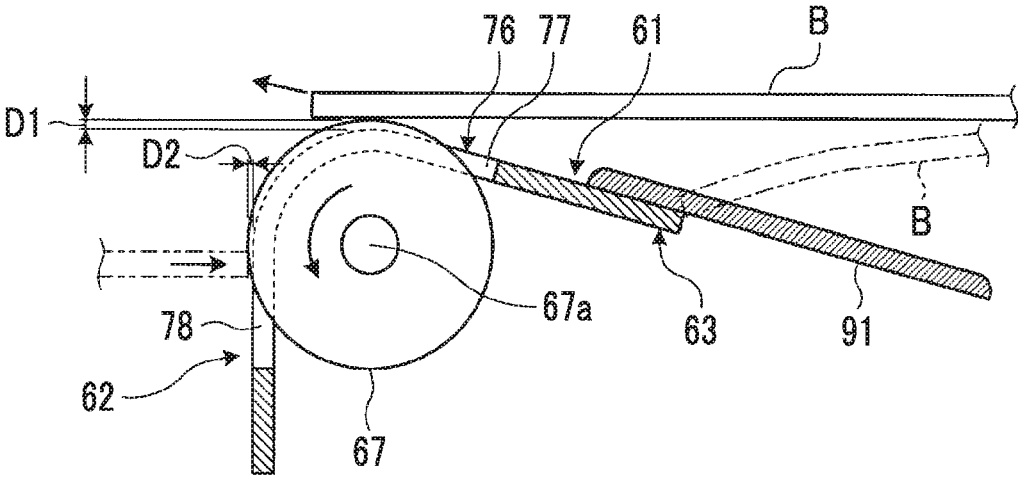
FIG. 7 is a schematic view illustrating a relationship between a guide plate and a guide roll.

Here, the guide device 23 will be described in detail. FIG. 3 is a front view illustrating the guide device in the sheet stacking device of the present embodiment, FIG. 4 is a plan view illustrating the guide device, FIG. 5 is a longitudinal sectional view illustrating the forward-backward adjustment device in the guide device, FIG. 6 is a longitudinal sectional view the upward-downward adjustment device in the guide device, and FIG. 7 is a schematic view a illustrating the relationship between a guide plate and a guide roll.

As illustrated in FIGS. 2 to 6, the guide device 23 is disposed between the hopper unit 21 and the ejection rolls 22, and has a first guide part 61 and a second guide part 62. The first guide part 61 guides a lower surface of a sheet-like cardboard box B and is disposed in the horizontal direction. The second guide part 62 guides a rear end of the sheet-like cardboard box B and is disposed in the vertical direction.

The first guide part 61 and the second guide part 62 are constituted by a guide plate 63 having an L-shaped section. The guide plate 63 has a predetermined thickness, a predetermined width, and a predetermined length, and is constituted of a horizontal part 64 that constitutes the first guide part 61, a vertical part 65 that constitutes the second guide part 62, and a bending part 66 that connects the horizontal part 64 and the vertical part 65 together. Although the horizontal part 64 is disposed in the horizontal direction, the horizontal part 64 is tilted slightly downward from the hopper unit 21 side toward the ejection rolls 22 side with respect to the transport direction of the cardboard box B. However, the horizontal part 64 is not limited to this arrangement, and may be made horizontal or may be inclined slightly upward from the hopper unit 21 side toward the ejection rolls 22 side. Additionally, the horizontal part 64 may be bent or curved from the middle with the hopper unit 21 side being horizontal and inclined slightly upward or downward toward the ejection rolls 22 side.

The vertical part 65 is disposed in the vertical direction. However, the vertical part 65 is not limited to this arrangement, and a lower end thereof may be inclined toward the hopper unit 21 side or the ejection rolls 22 side. The bending part 66 is curved at about 90 degrees, and connects the end of the horizontal part 64 on the hopper unit 21 side and an upper end of the vertical part 65 together. Also, the horizontal part 64 has a first guide surface 61*a* formed on an upper surface thereof, and the vertical part 65 has a second guide surface 62*a* formed on the hopper unit 21 side.

Additionally, the guide device 23 is provided with a guide roll 67 that guides a lower surface of the cardboard box B and guides the rear end of the cardboard box B. The guide roll 67 protrudes upward in the vertical direction from the first guide surface 61*a* of the first guide part 61, and protrudes from the second guide surface 62*a* of the second guide part 62 to the hopper unit 21 side.

The ejection rolls 22 (the upper ejection roll 22A and the lower ejection roll 22B) has a rotation center disposed in the machine width direction, and has respective ends supported in a rotationally drivable manner on the frames 31 on both sides. A cover 70 that covers an outer peripheral surface of on the hopper unit 21 side is disposed in the lower ejection roll 22B. The cover 70 has a curved shape along the outer peripheral surface of the lower ejection roll 22B, and is disposed with a predetermined gap from the outer peripheral surface of the lower ejection roll 22B. The cover 70 covers only a lower side of the lower ejection roll 22B on the hopper unit 21 except the transport passage for the cardboard box B transported above the ejection roll 22B, thereby securing the transport passage for the cardboard box B. Also, the cover 70 has respective ends in its width direction fixed to the frames 31 on both sides. The guide device 23 is mounted on the cover 70.

An attachment bracket 71 is disposed in the machine width direction outside the cover 70, and has an upper end fastened to the cover 70 with a plurality of bolts 72. The attachment bracket 71 is provided with an attachment part 71*a* that is long in the machine width direction and extends downward in the vertical direction, and has a substrate 74 fixed to a planar part thereof via a shim 73. The substrate 74 is disposed in the machine width direction and has an attachment part 74*a* in the vertical direction provided at each end thereof in the machine width direction, and the attachment part 74*a* is fastened to the attachment part 71*a* of the attachment bracket 71 with a plurality of bolts 75.

Meanwhile, the guide plate 63 has a plurality of (only one is illustrated in the present embodiment) cutouts 76 is formed at predetermined intervals in its longitudinal direction (machine width direction). Each cutout 76 extends from the bending part 66 to the horizontal part 64 side, and extends to the vertical part 65 side to form an L-shape. Namely, the first guide part 61 is provided with a first cutout 77 that passes therethrough in the vertical direction, the second guide part 62 is provided with a second cutout 78 that passes therethrough in the horizontal direction, and the first cutout 77 and second cutout 78 are constituted as one cutout 76 that passes through a region including the bending part 66 of the guide plate 63. Additionally, the cutout 76 is formed with a cutout 76*a* for a roll, and a pair of cutouts 76*b* for bearings that is continuous on both sides in the machine width direction.

The above-described substrate 74 supports the guide plate 63. That is, a plurality of supporting parts 74*b* that extend upward between the respective attachment parts 74*a* are provided at predetermined intervals in the machine width direction on the substrate 74. Each supporting part 74*b* has an upper end coupled to both sides of the cutout 76 in the guide plate 63. Also, each supporting part 74*b* has a bearing 79 fixed to a planar part on its facing side, and has each supporting shaft 67*a* of the aforementioned guide roll 67 rotatably supported thereby. That is, the guide plate 63 has a plurality of the guide rolls 67 disposed at predetermined intervals in the longitudinal direction (machine width direction) thereon, and each guide roll 67 is capable of being rotated by a force exerted from the outside with a rotation center in the machine width direction.

In this case, each guide roll 67 is disposed at the cutout 76*a* for a roll in the guide plate 63, and each bearing 79 is disposed at each cutout 76*b* for a bearing. For that reason, a portion of an outer peripheral part of the guide roll 67 protrudes outward from the guide plate 63. That is, as illustrated in FIG. 7 in detail, a portion of an outer peripheral surface of the guide roll 67 protrudes by a protrusion amount D1 upward in the vertical direction from the first guide surface 61*a* through the first cutout 77 of the guide plate 63. Additionally, a portion of the outer peripheral surface of the guide roll 67 protrudes by a protrusion amount D2 to the hopper unit 21 side from the second guide surface 62*a* through the second cutout 78 of the guide plate 63. It is preferable that the protrusion amounts D1 and D2 are, for example, about 1 mm to 5 mm. Also, a portion of the guide roll 67 protruding upward from the first guide surface 61*a* guides the lower surface of the cardboard box B to be transported, and a portion of the guide roll 67 protruding from the second guide surface 62*a* to the hopper unit 21 side guides the rear end of the cardboard box B that falls to the hopper unit 21.

Additionally, as illustrated in FIGS. 5 and 6, the guide device 23 has a first adjusting device 81 that adjusts the position of the first guide part 61 in the vertical direction, and a second adjusting device 82 that adjusts the position of the second guide part 62 in the horizontal direction.

In the second adjusting device 82, the shim 73 is interposed between the attachment bracket 71 and the substrate 74. That is, the substrate 74 has the attachment part 74*a* disposed at the attachment part 71*a* of the attachment bracket 71 via the shim 73, and is fastened to the attachment bracket 71 with the plurality of bolts 75. Additionally, a first adjusting bolt 83 passes through the substrate 74 in the horizontal direction, is threadedly engaged with the shim 73, and is locked by a locking nut 84. For that reason, after each bolt 75 is loosened, the locking nut 84 is loosened to rotate the first adjusting bolt 83, and the threaded engagement with the shim 73 is released to replace the shim 73 with another shim 73 with a different thickness. Then, the first adjusting bolt 83 is rotated to threadedly engage with the shim 73 after the replacement, and is locked by the locking nut 84 to fasten the bolt 75. Then, the positions of the first guide part 61 (second guide part 62) and the guide roll 67 in the horizontal direction are changed by a difference between the thickness of the shim 73 before the replacement and the thickness of the shim 73 after the replacement.

In the first adjusting device 81, the substrate 74 is formed with a plurality of adjustment holes 74*c*, which pass through the attachment part 74*a* running in the vertical direction, in the horizontal direction. Each adjustment hole 74*c* is an elongated hole that is long in the vertical direction, and the bolt 75 passes through the adjustment hole. Additionally, the substrate 74 is provided with a horizontal supporting piece 74*d*. Meanwhile, the attachment bracket 71 has a supporting plate 85 fixed to the attachment part 71*a* with a bolt 86, and the supporting plate 85 has a supporting part 85*a*. A second adjusting bolt 87 is threadedly engaged with the supporting part 85*a* upward in the vertical direction, and is locked by a locking nut 88 in a state where a distal end thereof abuts against supporting piece 74*d*. For that reason, if the locking nut 88 is loosened to normally and reversely rotate the second adjusting bolt 87 after each bolt 75 is loosened, the second adjusting bolt 87 pushes up the substrate 74 via the supporting part 85*a*, or the substrate 74 moves downward due to its own weight. If the substrate 74 moves upward and downward, the first guide part 61 (the second guide part 62) and the guide roll 67 also moves upward and downward. Then, loosening is prevented by the locking nut 88 at a predetermined lifted or lowered position to fasten the bolt 75. Then, the positions of the first guide part 61 (second guide part 62) and the guide roll 67 in the vertical direction are changed by the movement amount of the second adjusting bolt 87.

As illustrated in FIGS. 3 to 6, the guide device 23 is provided with a plurality of third guide parts 91 that connect the lower ejection roll 22B and the first guide part 61 (the horizontal part 64 of the guide plate 63) together. Each third guide part 91 is a plate member having a predetermined width and a predetermined length, and has a base end placed on and fixed to a distal end of the horizontal part 64 in the guide plate 63. Meanwhile, the lower ejection roll 22B has a plurality of circumferential grooves 22*b* in the circumferential direction formed at predetermined intervals in the axial direction, and the third guide part 91 has a distal end disposed within each circumferential groove 22*b*. The plurality of third guide parts 91 are disposed in the transport direction of the cardboard box B, and are provided at predetermined intervals in the machine width direction.

Additionally, the guide device 23 is provided with a cover member 95 that hangs downward from the second guide part 62 (the vertical part 65 of the guide plate 63). The cover member 95 is made of an elastic member, such as rubber, and prevents the rear end of the cardboard box B from interfering with an attachment part including the first adjusting device 81 and the second adjusting device 82.

In addition, in the present embodiment, the guide plate 63 is provided with the first guide part 61 and the second guide part 62. However, the invention is not limited to this configuration. For example, the first guide plate for the first guide part 61 and the second guide plate for the second guide part 62 may be separately provided. Additionally, although the guide plate 63 is provided with one cutout 76 that constitutes the first cutout 77 and the second cutout 78, the first cutout 77 and the second cutout 78 may be independently provided.

Moreover, in the present embodiment, the guide plate 63 is constituted as one plate member. However, the invention is not limited to the configuration. For example, the guide plate 63 may be constituted of a plurality of split guide plates that are split in the machine width direction, and the split guide plates may be coupled together with bolts or the like. In this case, one guide roll 67 may be supported by one spilt guide plate. By virtue of this configuration, the guide plates can be made small-sized, the processing accuracy can be improved, and the processing cost can be suppressed.

Here, the operation of the sheet stacking device 20 of the present embodiment will be described. FIGS. 8A to 8E are schematic views illustrating the operation of the sheet stacking device.

Figure 8A:
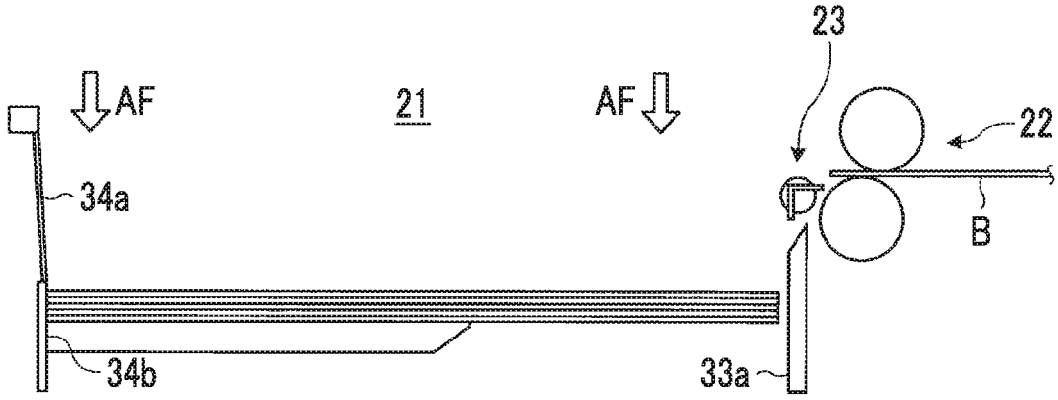
FIG. 8A is a schematic view illustrating the operation of the sheet stacking device.
Figure 8B:
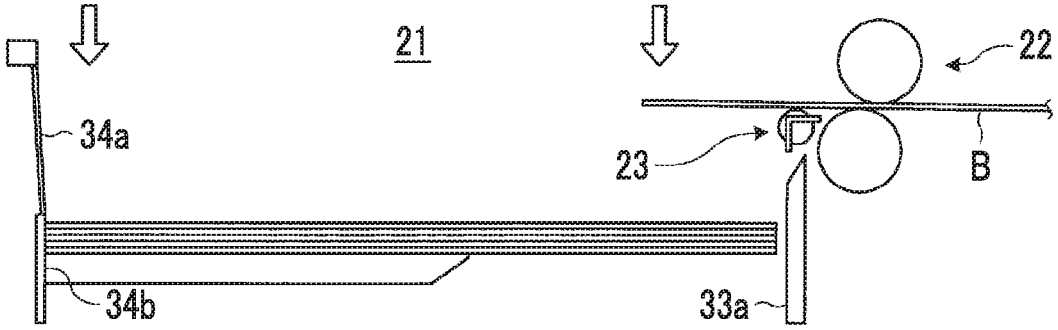
FIG. 8B is a schematic view illustrating the operation of the sheet stacking device.

As illustrated in FIG. 8A, the cardboard box B is transported by the ejection rolls 22, and is stacked into the hopper unit 21. In this case, since air is blown downward against the cardboard box B by the blowing devices 52 and 53 as indicated by white arrow AF, the downward movement of the cardboard box B is assisted. That is, as illustrated in FIG. 8B, the cardboard box B is ejected to the upper space of the hopper unit 21 in the horizontal direction by the ejection rolls 22. In this case, the cardboard box B first has the lower surface of a distal end supported by the guide device 23, and while the cardboard box B is ejected by the ejection rolls 22, the guide device 23 continues supporting the lower surface of the cardboard box B.

Describing in detail, as illustrated in FIG. 7, the cardboard box B ejected by the ejection rolls 22 is transported to the guide plate 63 with its lower surface being supported by the plurality of third guide parts 91, and is ejected to a position above the hopper unit 21 with its lower surface being continued to the first guide part 61 and the plurality of guide rolls 67. For that reason, a transport posture in a substantially horizontal state is maintained in the cardboard box B, and each guide roll 67 that comes into contact with the cardboard box B due to the movement of the cardboard box B rotates together. Therefore, the lower surface of the cardboard box B will not be scratched. If there is no third guide part 91, the distal end of the cardboard box B ejected by the ejection rolls 22 easily collides against the end of the guide plate 63 (first guide part 61) as indicated by a two-dot chain line in FIG. 7, and it is difficult to appropriately eject cardboard box B to the position above the hopper unit 21. Additionally, even if the distal end of the cardboard box B ejected by the ejection rolls 22 reaches an upper surface of the guide plate 63 (first guide part 61), there is a concern that the rear end of the cardboard box B comes into contact with the ejection rolls 22 and is caught in the ejection rolls 22.

Figure 8C:
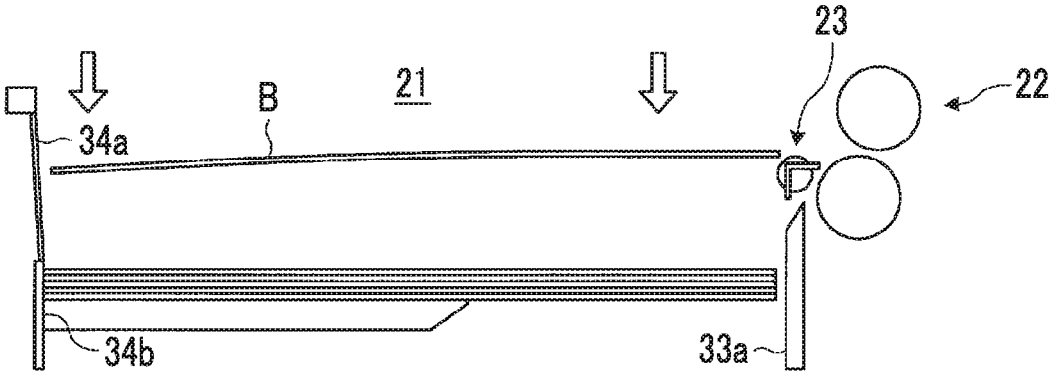
FIG. 8C is a schematic view illustrating the operation of the sheet stacking device.

Then, as illustrated in FIG. 8C, if the cardboard box B is released from the pinching by the ejection rolls 22, the cardboard box B is brought into a free state. However, the lower surface of the rear end of the cardboard box B is supported by the guide device 23, and the cardboard box B is maintained substantially horizontally above the hopper unit 21. Then, as illustrated in FIG. 8D, if the rear end of the cardboard box B passes through the guide device 23, the distal end of the cardboard box B abuts against the flexible stop plate 34*a* of the front stopper 34.

Figure 8D:
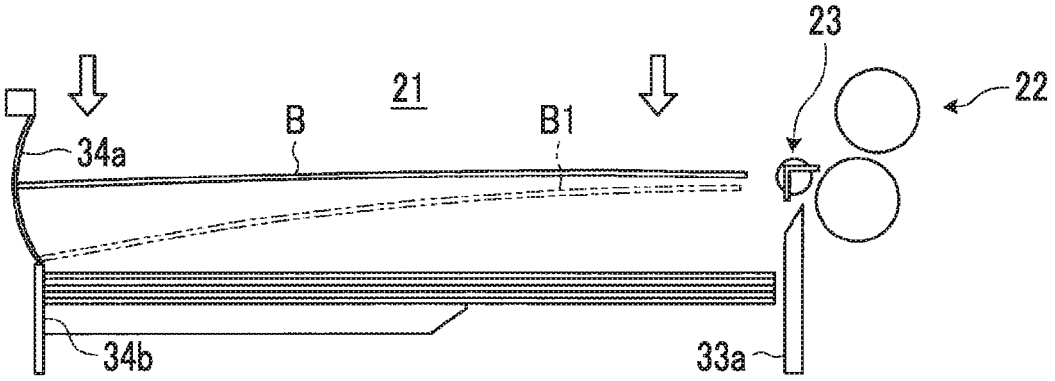
FIG. 8D is a schematic view illustrating the operation of the sheet stacking device.

In this case, if the cardboard box B is not supported by the guide device 23 when moving to a position above the hopper unit 21, as indicated by a two-dot chain line in FIG. 8D, a cardboard box B1 moves downward on its distal end side and takes a forwardly tilted posture, and consequently, falls into the hopper unit 21 in this posture. Therefore, the distal end abuts against the high-rigidity stop plate 34*b*, not the flexible stop plate 34*a* of the front stopper 34. The distal end of the cardboard box B1 is bent, and is not able to be appropriately stacked on the hopper unit 21.

The cardboard box B of which the lower surface is supported by the guide device 23 avoids the forward tilting, moves forward in a substantially horizontal posture, and abuts against the flexible stop plate 34*a* of the front stopper 34. Then, the flexible stop plate 34*a* absorbs the kinetic energy of the cardboard box B to decelerate its movement while being flexed. However, since the flexible stop plate 34*a* cannot absorb all the kinetic energy of the cardboard box B, as illustrated in FIG. 8E, the cardboard box B is moved downward while being moved backward by the reaction of the front stopper 34 after the distal end thereof abuts against the front stopper 34.

In this case, as illustrated in FIG. 7, in the guide device 23, the guide roll 67 comes into contact with the lower surface of the cardboard box B due to the movement of the cardboard box B, and rotates together. For that reason, the cardboard box B that moves downward while moving backward has a force exerted downward thereon when its rear end abuts against the rotating guide roll 67, and appropriately moves downward to the hopper unit 21 while being guided to the second guide surface 62*a* of the second guide part 62. In this way, the cardboard box B is appropriately stacked while maintaining a horizontally horizontal posture, and a proper stack T is stacked by a predetermined number of sheets and a batch is formed and ejected.

Figure 8E:
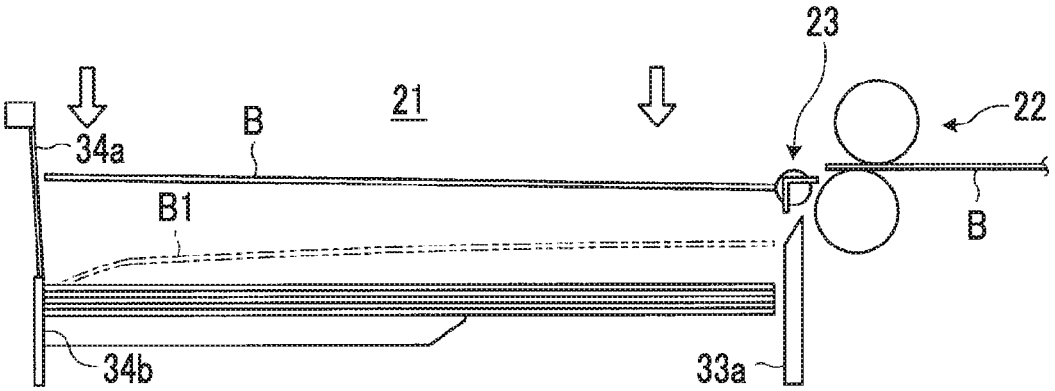
FIG. 8E is a schematic view illustrating the operation of the sheet stacking device.

Meanwhile, as indicate by a two-dot chain line in FIG. 8E, the cardboard box B1 of which the distal end has abutted against the high-rigidity stop plate 34*b* is stacked on the hopper unit 21 with its distal end being bent. Particularly, since a lightweight large-sized cardboard box B1 does not have sufficient rigidity, the cardboard box B1 is tilted forward from when being ejected to the position above the hopper unit 21 by the ejection rolls 22. Then, since the cardboard box B1 is stacked in state where its distal end is bent, when the ledge 37 enters the hopper unit 21 to collect the cardboard box B to form the stack T, a distal end of the ledge 37 and the distal end of the cardboard box B1 come into contact with each other and the cardboard box B1 breaks.

In this way, the sheet stacking device of the present embodiment is provided with the hopper unit 21 that stacks a sheet-like cardboard box B, the ejection rolls 22 that eject the cardboard box B to the hopper unit 21, and the guide device 23 that is disposed between the ejection rolls 22 and the hopper unit 21 and has the first guide part 61 that extends in the horizontal direction and guides the lower surface of the cardboard box B and the second guide part 62 that extends in a vertical direction and guides the rear end of the cardboard box B.

Therefore, if the cardboard box B is ejected by the ejection rolls 22, the cardboard box B has the lower surface supported by the first guide part 61. Accordingly, the downward and forward tilting of the distal end of the cardboard box B can be suppressed, and damage to the distal end can be suppressed by collision against the cardboard box B stacked on the hopper unit 21 being avoided. Additionally, if the cardboard box B slips out of the ejection rolls 22, the cardboard box B is brought into a free state. However, the cardboard box B can be appropriately stacked while its horizontal state is maintained by its rear end being supported by the second guide part 62. As a result, occurrence of damage to the cardboard box B with respect to high-speed transport of the cardboard box B can be suppressed, and the cardboard box B can be appropriately stacked in a predetermined posture.

In the sheet stacking device of the present embodiment, the guide device 23 has the guide rolls 67 that protrude upward in the vertical direction from the first guide surface 61*a* of the first guide part 61 and guide the lower surface of the cardboard box B. Therefore, since each guide roll 67 protrudes upward from the first guide surface 61*a*, the cardboard box B ejected by the ejection rolls 22 has the lower surface supported by the rotating guide roll 67. As a result, occurrence of scratch of the lower surface of the cardboard box B can be suppressed.

In the sheet stacking device of the present embodiment, the first guide part 61 is provided with the first cutout 77 that passes therethrough in the vertical direction, and a portion of the outer peripheral surface of the guide roll 67 protrudes upward from the first guide surface 61*a* through the first cutout 77. Therefore, the cardboard box B has the lower surface supported by the first guide surface 61*a* and the guide roll 67. As a result, the cardboard box B can be appropriately guided.

In the sheet stacking device of the present embodiment, the second guide part 62 is provided with the second cutout 78 that passes therethrough in the horizontal direction, and a portion of the outer peripheral surface of the guide roll 67 protrudes from the second guide surface 62*a* to the hopper unit 21 side through the second cutout 78. Therefore, since the guide roll 67 rotates as the cardboard box B to be ejected comes into contact with the guide roll 67, when the cardboard box B is stacked on the hopper unit 21, the rear end thereof comes into contact with the rotating guide roll 67 and are pushed downward. As a result, the behavior of the cardboard box B can be stabilized and the cardboard box B can be appropriately stacked on the hopper unit 21.

In the sheet stacking devices of the present embodiment, the first guide part 61 and the second guide part 62 are constituted by the guide plate 63 having an L shaped section, and the first cutout 77 and the second cutout 78 are constituted as one cutout 76 that passes through the region including the bending part 66 of this guide plate 63. Therefore, the structure of the first guide part 61 and the second guide part 62 can be simplified, and the processing cost can be suppressed.

In the sheet stacking device of the present embodiment, the cover 70 that covers the hopper unit 21 side in the ejection rolls 22 is disposed, and the guide device 23 is mounted on the cover 70. Therefore, the guide device 23 can be supported by the cover 70 as an existing member, an increase in cost can be suppressed by suppressing an increase in the number of attachment parts, and easiness of assembling can be improved.

The sheet stacking device of the present embodiment is provided with the first adjusting device 81 that adjusts the position of the first guide part 61 of the guide device 23 in the vertical direction. Therefore, the first guide part 61 can be disposed at an optimal position by adjusting the position of the first guide part 61 in the vertical direction using the first adjusting device 81 during the assembling of the guide device 23. Additionally, the cardboard box B can be appropriately stacked irrespective of the type of the cardboard box B by adjusting the position of the first guide part 61 in accordance with types, such as the size or hardness of the cardboard box B.

The sheet stacking device of the present embodiment is provided with the second adjusting device 82 that adjusts the position of the second guide part 62 of the guide device 23 in the horizontal direction. Therefore, the second guide part 62 can be disposed at an optimal position by adjusting the position of the second guide part 62 in the horizontal direction using the second adjusting device 82 during the assembling of the guide device 23. Additionally, the cardboard box B can be appropriately stacked irrespective of the type of the cardboard box B by adjusting the position of the second guide part 62 in accordance with types, such as the size or hardness of the cardboard box B.

In the sheet stacking device of the present embodiment, the guide device 23 has the third guide part 91 of which the base end is coupled to the first guide part 61, and the distal end of the third guide part 91 is disposed within the circumferential groove 22*b* of the lower ejection roll 22B. Therefore, the third guide part 91 is disposed between the first guide part 61 and the lower ejection roll 22B. Accordingly, the cardboard box B ejected by the ejection rolls 22 can be appropriately transported to the first guide part 61 by the third guide part 91.

Additionally, the counter ejector of the present embodiment is provided with the sheet stacking device 20. Therefore, the lower surface of the cardboard box B is supported by the first guide part 61. Accordingly, the downward and forward tilting of the distal end of the cardboard box B can be suppressed. Additionally, as the rear end of the cardboard box B is supported by the second guide part 62, fluttering of the cardboard box B can be suppressed, occurrence of damage to the cardboard box B with respect to high-speed transport of the cardboard box B can be suppressed, and the cardboard box B can be appropriately stacked in a predetermined posture.

Additionally, the box making machine of the present embodiment is provided with the sheet feed section 11, the printing section 12, the slotter creaser section 13, the die cutting section 14, the folder gluer section 15, and the counter ejector section 16, and the counter ejector section 16 is provided with the sheet stacking device 20. Therefore, printing is performed on the cardboard sheet S from the sheet feed section 11 by the printing section 12, ruling and grooving are performed by the slotter creaser section 13, folding is performed by the folder gluer section 15 to join ends together to form the cardboard box B, and the cardboard box B is stacked while being counted by the counter ejector section 16. In this case, in the counter ejector section 16, as the lower surface of the cardboard box B is supported by the first guide part 61, the downward and forward tilting of the distal end of the cardboard box B can be suppressed. Additionally, as the rear end of the cardboard box B is supported by the second guide part 62, fluttering of the cardboard box B can be suppressed, occurrence of damage to the cardboard box B with respect to high-speed transport of the cardboard box B can be suppressed, and the cardboard box B can be appropriately stacked in a predetermined posture.

In addition, in the above-described embodiment, the first guide part 61 and the second guide part 62, and the guide rolls 67 are provided to constitute the guide device 23. The invention is not limited to this configuration and the guide rolls 67 may be eliminated depending on box making sheets. Additionally, the guide part and the guide device may be configured by providing only one guide roll 67 without providing the first guide part 61 and the second guide part 62 or by providing a plurality of guide rolls 67 side by side in the transport direction of the cardboard box B.

Additionally, in the above-described embodiment, the cutouts 76 are formed in the guide plate 63 and the guide rolls 67 are made to protrude upward and forward. However, the invention is not limited to this configuration, and the guide rolls 67 may be made to protrude only upward, or the guide rolls 67 may be made to protrude only forward. Although the plurality of guide rolls 67 are disposed at predetermined intervals in the longitudinal direction, one long guide roll may be disposed in the longitudinal direction.

Additionally, in the above-described embodiment, the ejection unit of the invention is constituted by the ejection rolls 22 (the upper ejection roll 22A and the lower ejection roll 22B). However, the invention is not limited to this configuration. For example, a transporting conveyor may be used or other ejection devices may be used.

Additionally, in the above-described embodiment, the box making machine 10 is constituted by the sheet feed section 11, the printing section 12, the slotter creaser section 13, the die cutting section 14, the folder gluer section 15, and the counter elector section 16. However, in a case where hand holes are unnecessary for the cardboard sheet S, the die cutting section 14 may be eliminated.

REFERENCE SIGNS LIST

11: SHEET FEED SECTION
12: PRINTING SECTION
13: SLOTTER CREASER SECTION
14: DIE CUTTING SECTION
15: FOLDER GLUER SECTION
16: COUNTER EJECTOR SECTION (COUNTER EJECTOR)
20: SHEET STACKING DEVICE
21: HOPPER UNIT
22: EJECTION ROLL (EJECTION UNIT)
22A: UPPER EJECTION ROLL
22B: LOWER EJECTION ROLL
23: GUIDE DEVICE
31: FRAME
33: SPANKER
34: FRONT STOPPER
35: LEDGE SUPPORT
36: ELEVATOR
37: LEDGE
61: FIRST GUIDE PART
61*a*: FIRST GUIDE SURFACE
62: SECOND GUIDE PART
62*a*: SECOND GUIDE SURFACE
63: GUIDE PLATE
64: HORIZONTAL PART
65: VERTICAL PART
66: BENDING PART
67: GUIDE ROLL
70: COVER
71: ATTACHMENT BRACKET
74: SUBSTRATE
76: CUTOUT
77: FIRST CUTOUT
78: SECOND CUTOUT
79: BEARING
81: FIRST ADJUSTING DEVICE
82: SECOND ADJUSTING DEVICE
91: THIRD GUIDE PART
95: COVER MEMBER

B: CARDBOARD BOX (BOX MAKING SHEET)
S: CARDBOARD SHEET
T: STACK

The invention claimed is:

1. A sheet stacking device comprising:
a hopper unit that stacks box making sheets;
an ejection unit that ejects each of the box making sheets to the hopper unit; and
a guide device that is disposed between the ejection unit and the hopper unit and has a first guide part that guides a lower surface of the box making sheet in a horizontal direction, and a second guide part that guides a rear end of the box making sheet in a vertical direction, wherein
the ejection unit has an upper ejection roll and a lower ejection roll in which a circumferential groove is formed, the guide device has a third guide part of which a base end is coupled to the first guide part, and the third guide part has a distal end disposed within the circumferential groove.

2. The sheet stacking device according to claim 1,
wherein the guide device has a guide roll that protrudes upward in the vertical direction from a first guide surface of the first guide part to guide the lower surface of the box making sheet.

3. The sheet stacking device according to claim 2,
wherein the first guide part is provided with a first cutout that passes therethrough in the vertical direction, and a portion of an outer peripheral surface of the guide roll protrudes upward from the first guide surface through the first cutout.

4. The sheet stacking device according to claim 3,
wherein the second guide part is provided with a second cutout that passes therethrough in the horizontal direction, and a portion of the outer peripheral surface of the guide roll protrudes from the second guide surface to a side of the hopper unit through the second cutout.

5. The sheet stacking device according to claim 4,
wherein the first guide part and the second guide part are constituted by a guide plate having an L-shaped section, and the first cutout and the second cutout are constituted as one cutout that passes through a region including a bending part of the guide plate.

6. The sheet stacking device according to claim 1,
wherein a cover that covers a side of the hopper unit is disposed in the ejection unit, and the guide device is mounted on the cover.

7. The sheet stacking device according to claim 1,
wherein the guide device has a first adjusting device that adjusts a position of the first guide part in the vertical direction.

8. The sheet stacking device according to claim 7,
wherein the guide device has a second adjusting device that adjusts a position of the second guide part in the horizontal direction.

9. A counter ejector comprising:
the sheet stacking device according to claim 1,
wherein the box making sheets are sorted in a batch of a predetermined number of sheets and are ejected after being stacked while being counted.

10. A box making machine comprising:
a sheet feed section that supplies a box making sheet;
a printing section that performs printing on the box making sheet;
a slotter creaser section that performs ruling on a front surface of the box making sheet and performs grooving;
a folder gluer section that folds the box making sheet to join ends together, thereby forming a box member; and
a counter ejector section that ejects every predetermined number of the box members after being stacked while being counted,
wherein the counter ejector according to claim 9 is applied as the counter ejector section.

11. A sheet stacking device comprising:
a hopper unit that stacks box making sheets;
an ejection unit that ejects each of the box making sheets to the hopper unit; and
a guide device that is disposed between the ejection unit and the hopper unit and has a first guide part that guides a lower surface of the box making sheet in a horizontal direction, and a second guide part that guides a rear end of the box making sheet in a vertical direction, wherein
the guide device has a first adjusting device that adjusts a position of the first guide part in the vertical direction.

* * * * *